US008997982B2

(12) United States Patent
Makino et al.

(10) Patent No.: US 8,997,982 B2
(45) Date of Patent: Apr. 7, 2015

(54) CONTAINER

(75) Inventors: Katsunori Makino, Kuwana (JP); Tsutomu Hotta, Kuwana (JP); Kazuhiko Miyata, Mizuho (JP); Takashi Owashi, Mizuho (JP)

(73) Assignees: NTN Corporation, Osaka (JP); Sanko Co., Ltd., Mizuho (JP)

( * ) Notice: Subject to any disclaimer, the term of this patent is extended or adjusted under 35 U.S.C. 154(b) by 0 days.

(21) Appl. No.: 13/883,914

(22) PCT Filed: Sep. 16, 2011

(86) PCT No.: PCT/JP2011/071194

§ 371 (c)(1),
(2), (4) Date: May 7, 2013

(87) PCT Pub. No.: WO2012/070299

PCT Pub. Date: May 31, 2012

(65) Prior Publication Data

US 2013/0220854 A1 Aug. 29, 2013

(30) Foreign Application Priority Data

Nov. 25, 2010 (JP) ..... 2010-262214

(51) Int. Cl.

| | |
|---|---|
| ***B65D 25/10*** | (2006.01) |
| ***B65D 19/04*** | (2006.01) |
| ***B65D 85/02*** | (2006.01) |

(52) U.S. Cl.

CPC ..... *B65D 25/102* (2013.01); *B65D 19/04* (2013.01); *B65D 85/02* (2013.01); *B65D 25/107* (2013.01); *B65D 2519/00034* (2013.01);

(Continued)

(58) Field of Classification Search

CPC .... B65D 25/102; B65D 25/107; B65D 85/02; B65D 19/04

USPC ..... 206/318, 303, 565

See application file for complete search history.

(56) References Cited

U.S. PATENT DOCUMENTS 912,796 A * 2/1909 Boye ..... 206/389
2,448,447 A * 8/1948 Lau ..... 108/51.11

(Continued)

FOREIGN PATENT DOCUMENTS

DE 296 13 305 U1 11/1996
DE 296 13 305 1/1997

(Continued)

OTHER PUBLICATIONS

Written Opinion of the International Searching Authority Issued in Application No. PCT/JP2011/071194; Dated Oct. 31, 2011 (With Translation).

(Continued)

*Primary Examiner* — Steven A. Reynolds
*Assistant Examiner* — King M Chu
(74) *Attorney, Agent, or Firm* — Oliff PLC

(57) ABSTRACT

A container of the present invention includes a bridging member disposed between a pair of inner side faces of a band insertion groove formed in a bottom wall. A rolling bearing is arranged above the bridging member and a band can be wound around the bearing and the bridging member together. Thus, since both a sideslip and jumping of the rolling bearing can be prevented without covers, the container is more superior in usability to a conventional container requiring a cover, and the stacking height can be suppressed as well.

6 Claims, 13 Drawing Sheets

(52) U.S. Cl.
CPC ..... *B65D 2519/00069* (2013.01); *B65D 2519/00174* (2013.01); *B65D 2519/00268* (2013.01); *B65D 2519/00288* (2013.01); *B65D 2519/00318* (2013.01); *B65D 2519/00333* (2013.01); *B65D 2519/00338* (2013.01); *B65D 2519/00402* (2013.01); *B65D 2519/00407* (2013.01); *B65D 2519/00412* (2013.01); *B65D 2519/00422* (2013.01); *B65D 2519/00497* (2013.01); *B65D 2519/00621* (2013.01); *B65D 2519/00666* (2013.01); *B65D 2519/00815* (2013.01); *B65D 2519/00975* (2013.01)

(56) References Cited

U.S. PATENT DOCUMENTS

| | | | | |
|---|---|---|---|---|
| 3,180,607 | A | 4/1965 | Lee | |
| 3,318,443 | A * | 5/1967 | Hillis | 242/588.6 |
| 4,253,571 | A * | 3/1981 | Keohan | 206/308.3 |
| 4,499,994 | A * | 2/1985 | Rentch | 206/310 |
| 4,732,528 | A * | 3/1988 | Good | 414/802 |
| 4,829,909 | A * | 5/1989 | Mandel | 108/55.5 |
| 5,450,961 | A * | 9/1995 | Gottfried et al. | 206/394 |
| 5,829,363 | A | 11/1998 | Reilly | |
| 5,855,345 | A * | 1/1999 | DiMaggio | 248/176.1 |
| 7,562,775 | B2 * | 7/2009 | Hassdenteufel et al. | 206/318 |
| 7,699,167 | B2 * | 4/2010 | Voissem | 206/416 |
| 2008/0047853 | A1 | 2/2008 | Hassdenteufel et al. | |
| 2008/0277301 | A1 * | 11/2008 | Gill et al. | 206/446 |
| 2011/0061572 | A1 * | 3/2011 | Liu et al. | 108/55.5 |

FOREIGN PATENT DOCUMENTS

| | | |
|---|---|---|
| DE | 103 34 486 A1 | 3/2005 |
| DE | 10 2004 048286 A1 | 4/2006 |
| JP | A-03-36166 | 2/1991 |
| JP | B2-3321618 | 9/2002 |
| JP | A-2008-515730 | 5/2008 |

OTHER PUBLICATIONS

International Search Report issued in Application No. PCT/JP2011/071194; Dated Nov. 8, 2011 (With Translation).
Aug. 6, 2014 Office Action issued in Japanese Application No. 2010-262214 (with translation).
Jul. 3, 2014 Office Action issued in Chinese Application No. 201180056772.1 (with translation).
Jun. 23, 2014 Search Report issued in European Patent Application No. 11842531.

* cited by examiner

CONTAINER

TECHNICAL FIELD

The present invention relates to a container capable of preventing a sideslip and jumping of a housed workpiece.

BACKGROUND ART

As this type of container, such a container is conventionally known that prevents a sideslip of a workpiece by bringing a plurality of projections projecting from a bottom face into contact with side faces of the workpiece and also prevents jumping of the workpiece by closing an upper face opening of the container with a cover and winding a band around the closed container from above the opening (see, for example, Patent Document 1).

PRIOR ART DOCUMENT

Patent Document

Patent Document 1: Japanese Unexamined Patent Application Publication (Translation of POT Application) No. 2008-515730 (Paragraph [0026], FIG. 9, FIG. 10a)

SUMMARY OF THE INVENTION

Problems to be Solved by the Invention

However, the above-described conventional container is poor in usability, because the band and the cover are required to be detached every time it is desired to visually check a type, size or the like of the housed workpiece. Additionally, disadvantageously, a cover is required for every container in stacking a plurality of containers, and the stacking height increases.

The present invention has been made in view of the above problems, and it is an object thereof to provide a container which is more superior in usability to the conventional container and capable of suppressing the stacking height.

Means for Solving the Problem

A container capable of preventing a slideslip and jumping of a housed workpiece according to the invention of claim 1 for achieving the above object is characterized in that a band insertion groove is formed in a bottomwall of the container, a bridging member is disposed between a pair of inner side faces of the band insertion groove, and a workpiece is arranged above the bridging member so that a band can be wound around the workpiece together with the bridging member.

In the invention of claim 2, the container of claim 1 is characterized in that the workpiece is annular and the band is made to pass inside and outside the annular workpiece and can be wound around the workpiece and the bridging member together.

In the invention of claim 3, the container of claim 1 or 2 is characterized in that the band insertion groove has an end part provided with a band guide part gradually rising upward from the bottom face of the band insertion groove with increasing distance from the bridging member.

In the invention of claim 4, the container of any one of claims 1 to 3 is characterized in that the band insertion groove is formed at the center in a width direction of a bottom face of a horizontal positioning groove formed in the bottom wall of the container, a plurality of horizontal positioning engaging parts are aligned at one side part of the horizontal positioning groove, and sideslip regulating components are provided, the regulating component being detachably received by the horizontal positioning groove and concavo-convexly engaged with any of the horizontal positioning engaging parts, part of the regulating component being covered with the workpiece from above and another part thereof being brought into contact with the workpiece from the side.

Effect of the Invention

[Invention of Claim 1]

A container of claim 1 can prevent both a sideslip and jumping of a workpiece by arranging the workpiece above the bridging member disposed between a pair of inner side faces of the band insertion groove and bundling the bridging member and the workpiece with a band. Since the container of the present invention thus can prevent both a sideslip and jumping of the workpiece with no cover, the container is more superior in usability to a conventional container requiring a cover and the stacking height can be suppressed.

[Invention of Claim 2]

Since, in the container of claim 2, the band is made to pass through the inside and outside of an annular workpiece and can be wound around the workpiece and the bridging member together, the band is shortened and prevented from loosening as compared with the case where a band is wound so as to surround the whole of the workpiece or the case where, as conventionally, a band is wound around a container and a cover together.

[Invention of Claim 3]

According to the container of claim 3, when the band is made to pass through under the bridging member, a tip end of the band slide-contacts with a band guide part at an end part of the band insertion groove and is guided upward. Thus, the winding of the band around the workpiece is facilitated.

[Invention of Claim 4]

According to the container of claim 4, since the band insertion groove is formed in a bottom face of a horizontal positioning groove formed in the bottom wall of the container, either attaching a sideslip regulating component in the horizontal positioning groove for preventing a sideslip of the workpiece or inserting a band into the band insertion groove for preventing a sideslip and jumping of the workpiece can be selected appropriately, the degree of freedom of choice of usage of the container is increased.

MODES FOR CARRYING OUT THE INVENTION

Figure 1:
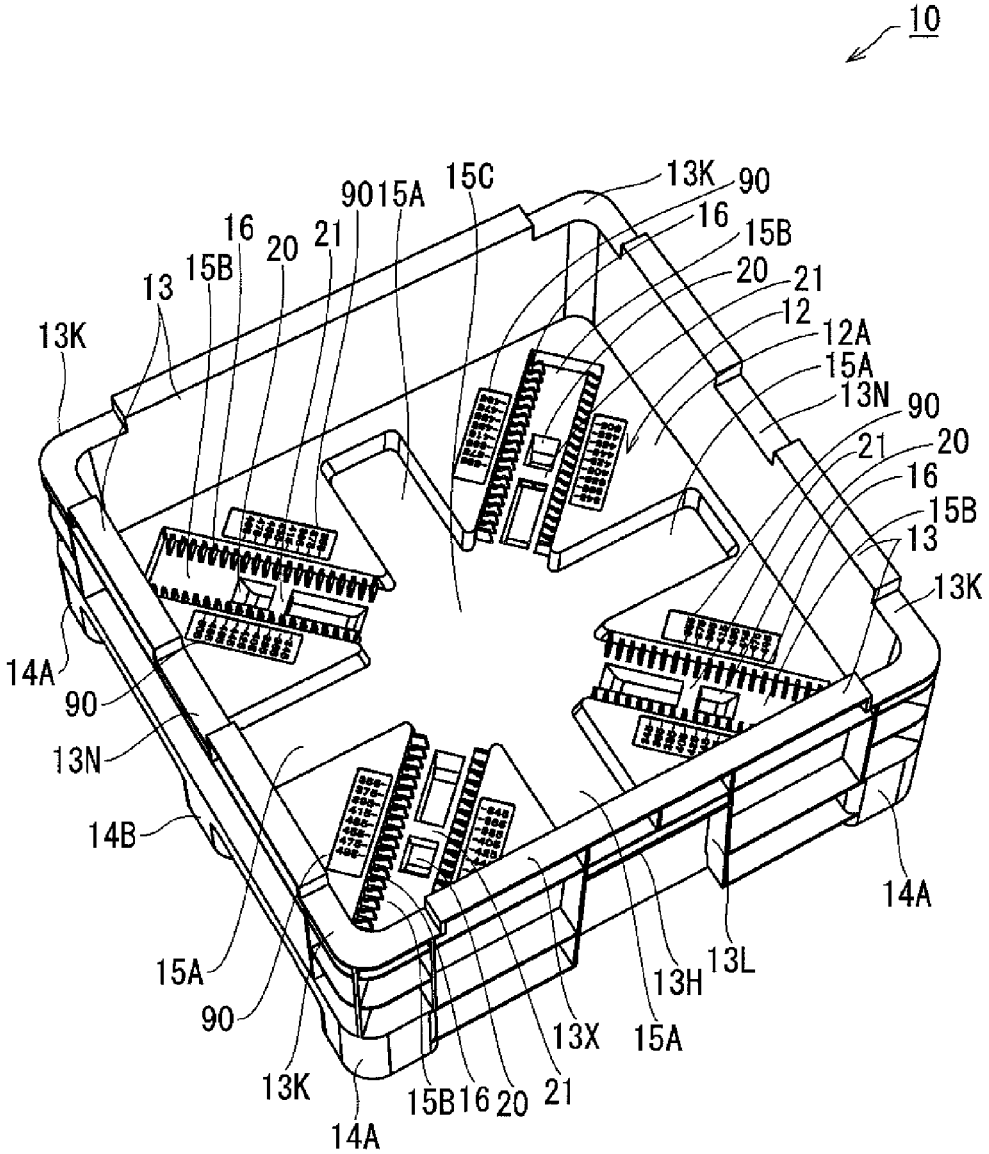
FIG. 1 is a perspective view of a container according to an embodiment of the present invention.

Hereinafter, an embodiment of the present invention will be described with reference to FIGS. 1 to 10. As shown in FIG. 1, a container 10 according to the present invention (hereinafter, simply called a "container 10") is in the shape of a rectangular parallelepiped having an opened upper face, and can house a rolling bearing W (see FIG. 5) corresponding to a "workpiece" of the present invention, with the bearing W lying down.

Specifically, as shown in FIG. 1, a bottom wall 12 of the container 10 is substantially square in a plan view, and side walls 13 are erected from outer edge parts, corresponding to four sides of the square, of the bottom wall 12. Reinforcing ribs 13B project from an outer face of respective side walls 13, and a part of the reinforcing ribs 13L is arranged throughout an upper edge of the side wall 13 to constitute an upper face flange 13X. Handle parts 13H (only one of the handle parts 13H is shown in FIG. 1) on which fingertips are put when the container 10 is lifted up, are constituted by the horizontally extending reinforcing ribs 13L at the centers of upper parts of outer faces of the pair of side walls 13 facing each other in a first horizontal direction.

Figure 2:
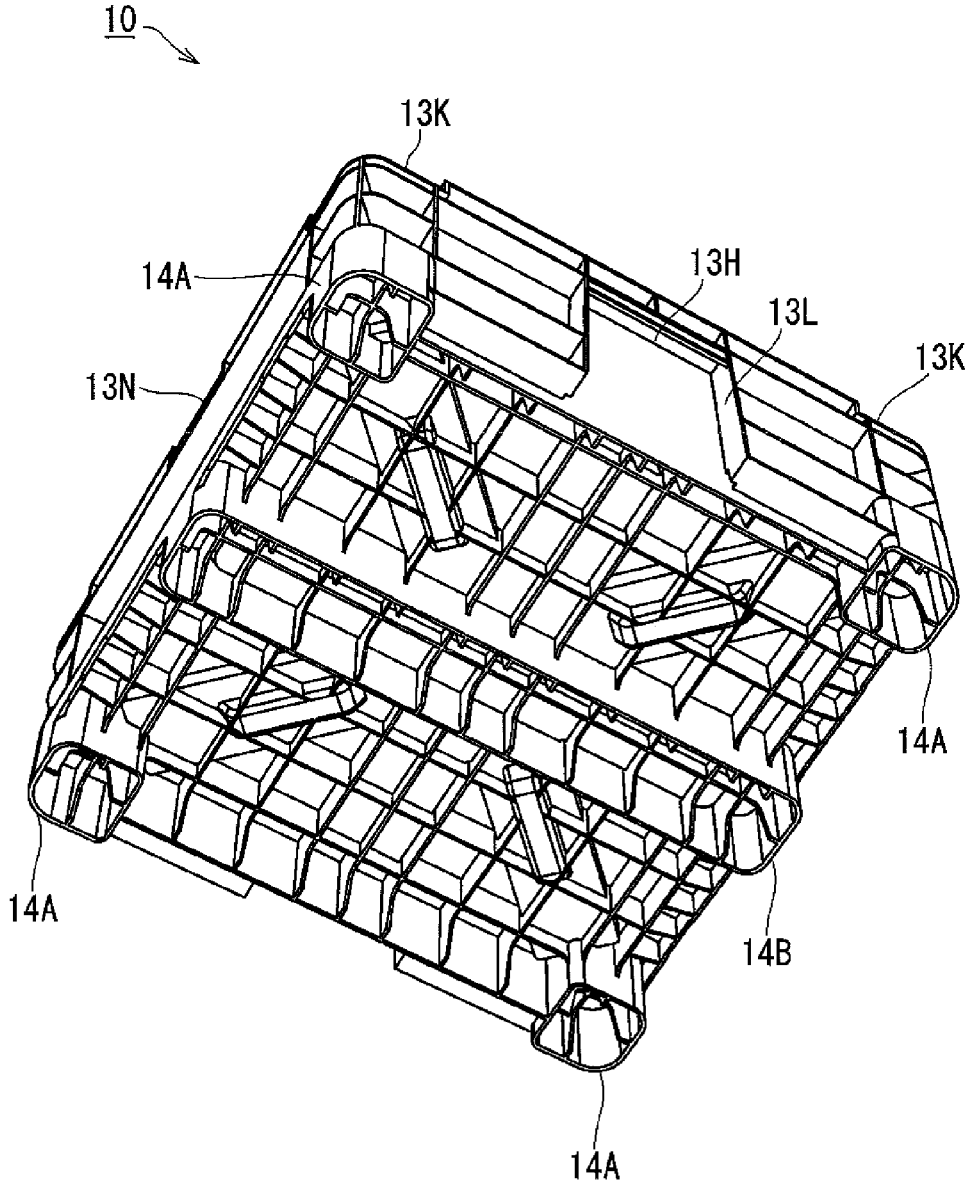
FIG. 2 is a perspective view of the container viewed from below.

Upper face recess parts 13K are respectively formed at four corners of the upper face of the container 10 by recessing the upper face flanges 13X, and lower face leg parts 14A respectively project from four corners of a lower face of the container 10. When the containers 10 are stacked, each lower face leg part 14A is fitted in each upper face recess part 13K. A pair of upper face center recess parts 13N is formed at the centers of upper faces of the pair of side walls 13 not having the handle parts 13H, by recessing the upper face flanges 13X. On the other hand, as shown in FIG. 2, on the lower face of the container 10, a lower face center leg part 14B projects downward from the whole of a strip-shaped region connecting between the pair of upper face center recess parts 13N. Only when the lower face center leg part 14B is arranged opposite the upper face center recess parts 13N between upper and lower containers 10, the upper container 10 can be stacked on the lower container 10.

As shown in FIG. 1, a substantially circular center recessed part 15C is formed in a stepped shape by recessing the center of an upper face of the bottom wall 12 of the container 10, that is, a bottom face 12A of the container 10, and a plurality of bearing taking-out grooves 15A and a plurality of horizontal positioning grooves 153 radially extend from the center recessed part 15C. The bearing taking-out grooves 15A and the horizontal positioning groove 153 are recessed in a stepped shape from the bottom face 12A of the container 10. The horizontal positioning grooves 15B are arranged along a diagonal line of the bottom face 12A, and the bearing taking-out groove 15A is arranged at the center between the adjacent horizontal positioning grooves 15B.

Figure 3:
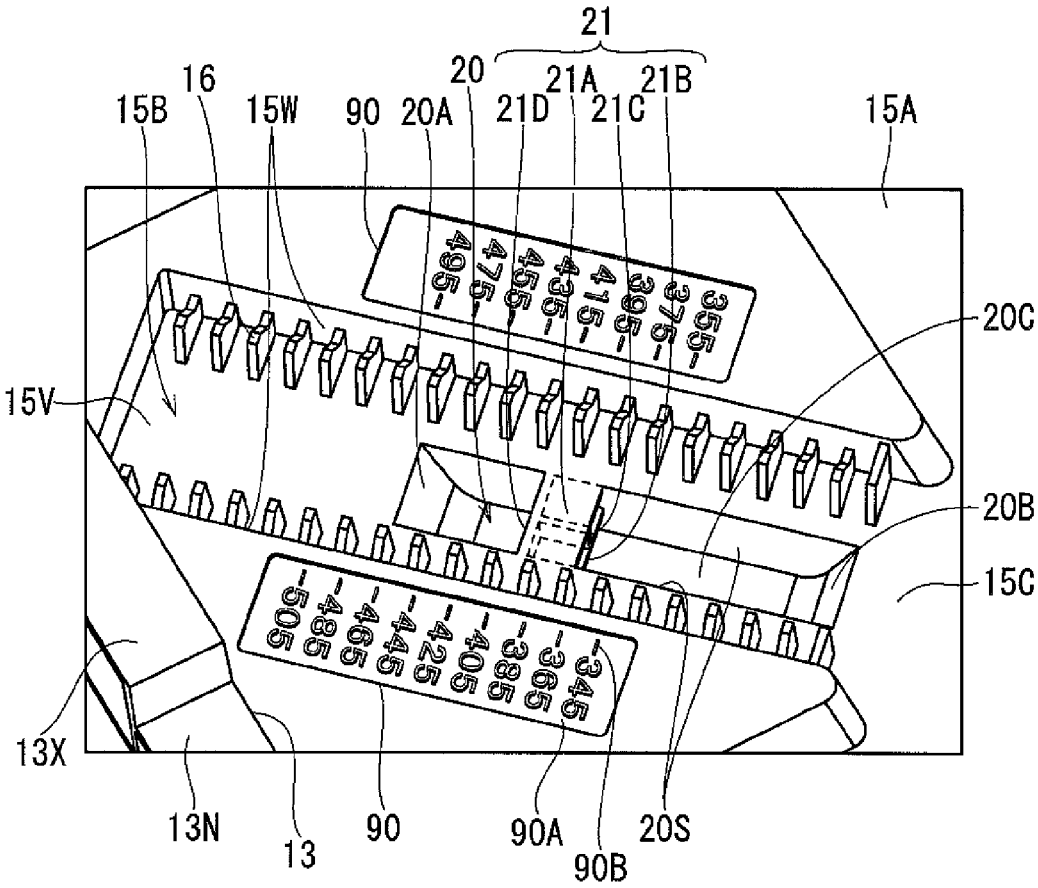
FIG. 3 is a perspective view of a horizontal positioning groove and a band insertion groove.

As shown in FIG. 3, a plurality of positioning projection pieces 16 (corresponding to "horizontal positioning engaging parts" of the present invention) are arranged at equal intervals at each side part inside the horizontal positioning groove 15B in its longitudinal direction. Each positioning projection piece 16 is joined to a bottom face 15V and an inner side face 15W of the horizontal positioning groove 15B. Among the group of positioning projection pieces 16, the positioning projection piece 16 positioned at an end of the center recessed part 15C side is quadrilateral, but the other positioning projection pieces 16 are all odd-shaped. Specifically, the other positioning projection pieces 16 each are formed in a shape that an end near the outside of its upper end face is lower than an end near the inside thereof and the end near the outside and the end near the inside are connected by an inclined face.

Moreover, as shown in FIG. 1, the bearing taking-out groove 15A has a flat bottom face and flat side faces, so that the rolling bearing W can be easily taken out from the container 10 by inserting a tool or a finger into the bearing taking-out groove 15A from the center recessed part 150.

Figure 4A:
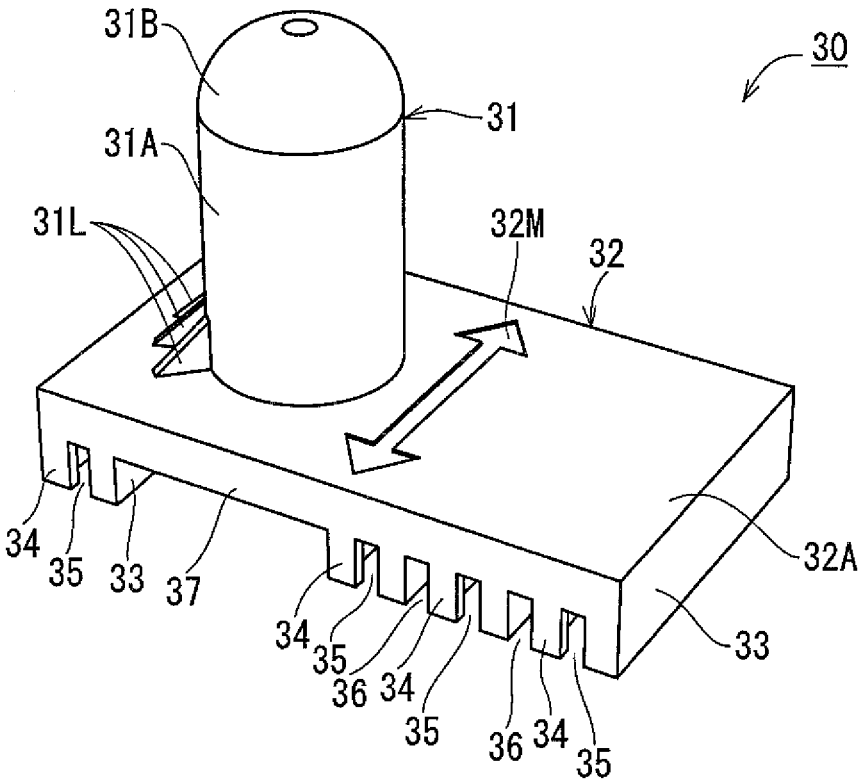
FIG. 4A is a perspective view of an upper face of a sideslip regulating component.
Figure 4B:
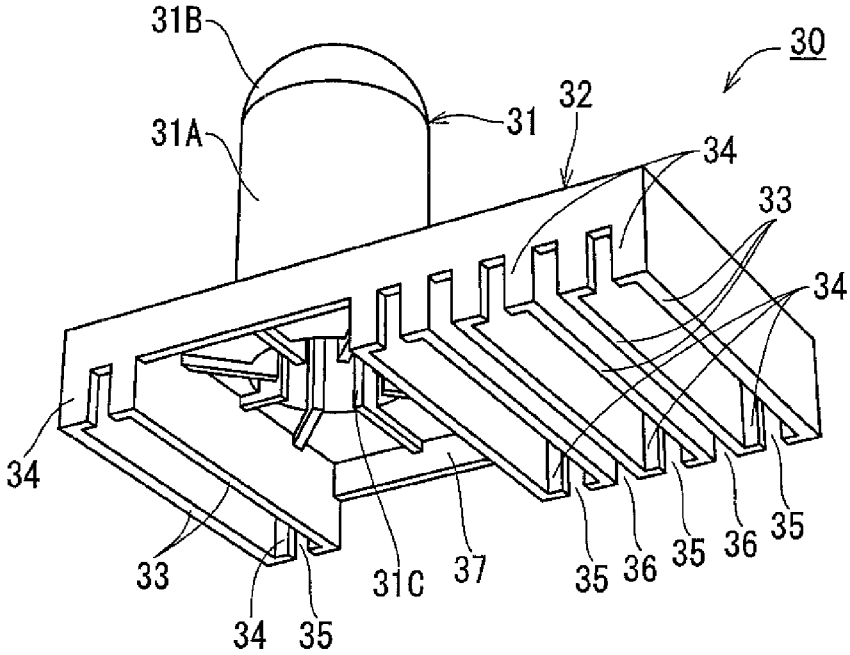
FIG. 4B is a perspective view of a lower face of the sideslip regulating component.

A sideslip regulating component 30 shown in FIG. 4A is detachably attached to the horizontal positioning groove 15B. The sideslip regulating component 30 has a structure that a positioning projection part 31 is erected from a base part 32. The base part 32 is such that a plurality of engagement leg pieces 33 hang downward from a base plate 32A extending in the longitudinal direction of the horizontal positioning groove 15B and having a rectangular shape in a plan view. As shown in FIG. 4B, the engagement leg pieces 33 each are in a flat plate shape, and plurally and unequally located on both end parts in a longitudinal direction of the base plate 32 A. In detail, two engagement leg pieces 33 are arranged on one end part of the base plate 32A, and six engagement leg pieces 33 are arranged on the other end part thereof. Every two engagement leg pieces 33 from the one end part side are paired, and a gate-shaped wall 34 is connected between side edge parts of the paired engagement leg pieces 33. A slit 35 is formed from a lower end to a position near an upper end of each gate-shaped wall 34. Leg piece connecting walls 37 are projected downward from edge parts of both ends in a width direction of the base plate 32A. A lower end of the leg piece connecting wall 37 is arranged at the same height as that of the upper end of the slit 35 in a vertical direction.

Moreover, at the other end part of the base plate 32A, between the engagement leg pieces 33 not connected by the gate-shaped wall 34 serves as a projection piece receiving gap 36. The projection piece receiving gap 36 has substantially the same width as the slit 35.

As shown in FIG. 4A, a positioning mark 32M is marked on an upper face of the base part 32. The positioning mark 32M is arranged at a longitudinal center of the upper face of the base part 32, extends in a width direction of the upper face of the base part 32 and has both ends in the shape of an arrowhead.

The positioning projection part 31 is such that an upper end of a cylindrical body 31A erected from a position near one end in the longitudinal direction of the base part 32 is closed by a dome-shaped (semispherical) upper end wall 31B. As shown in FIG. 4B, reinforcing inner ribs 31C are projected from an inner circumferential face of the base part 32 toward the center thereof. At a lower end part of the positioning projection part 31, reinforcing ribs 31L are provided on a part, which is positioned at one end side in the longitudinal direction of the base part 32, of an outer circumferential face of the positioning projection part 31.

Moreover, as shown in FIG. 1, outer diameter displaying parts 90 are marked on both side edge parts of each horizontal positioning groove 15B on the bottom face 12A of the container 10. As shown in FIG. 3 under magnification, each outer diameter displaying part 90 is constituted by a plurality of diameter displaying parts 90A arranged at the same pitch as the positioning projection pieces 16 and a plurality of positioning lines 90B extending from the diameter displaying parts 90A toward the horizontal positioning groove 15B.

As shown in FIG. 3, a band insertion groove 20 is formed at a part of the bottom face 15V of each horizontal positioning groove 15B, the part whose both sides are disposed between the group of the positioning projection pieces 16. The band insertion groove 20 extends from the end of the center recessed part 15C side in the longitudinal direction of the horizontal positioning groove 15B to the center thereof. A bottom face 20C of the band insertion groove 20 is a horizontal plane parallel to the bottom face 15V of the horizontal positioning groove 15B, and both inner side faces 20S of the band insertion groove 20 each are a vertical plane perpendicular to the bottom face 15V of the horizontal positioning groove 15B and the bottom face 20C of the band insertion groove 20. Flat inclined faces 20A and 20B corresponding to "band guide parts" of the present invention are provided at both end parts in a longitudinal direction of the band insertion groove 20, and the inclined faces 20A and 20B and the bottom face 20C are r-chamfered therebetween to continue gently.

Figure 8:
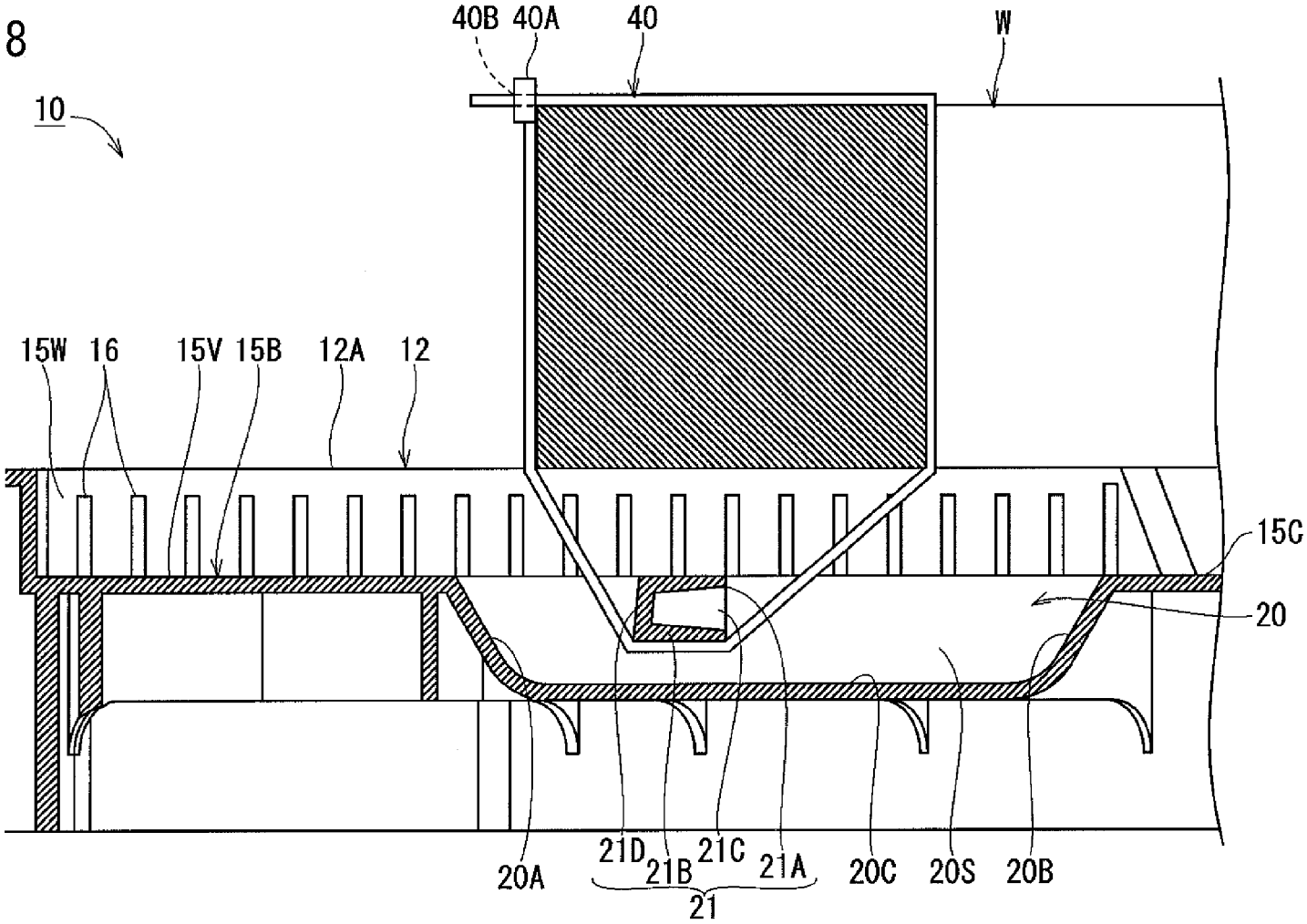
FIG. 8 is a sectional side view of the partially enlarged container.

A bridging member 21 is disposed between the pair of inner side faces 20S at a middle part in the longitudinal direction of the band insertion groove 20. As shown in FIG. 8, the bridging member 21 is composed of an upper face plate 21A having an upper face flush with the bottom face 15V of the horizontal positioning groove 15B, a lower face plate 21B having the same scale as the upper face plate 21A and facing the upper face plate 21A from just below at a substantially center in a depth direction of the band insertion groove 20, a closing plate 21D for closing an entire opening at a side away from the center recessed part 15C between the upper face plate 21A and the lower face plate 21B, and a vertical rib 21C connecting among the upper face plate 21A, the lower face plate 21B and the closing plate 21D at a width-direction center of the band insertion groove 20 as shown in FIG. 3.

Figure 5:
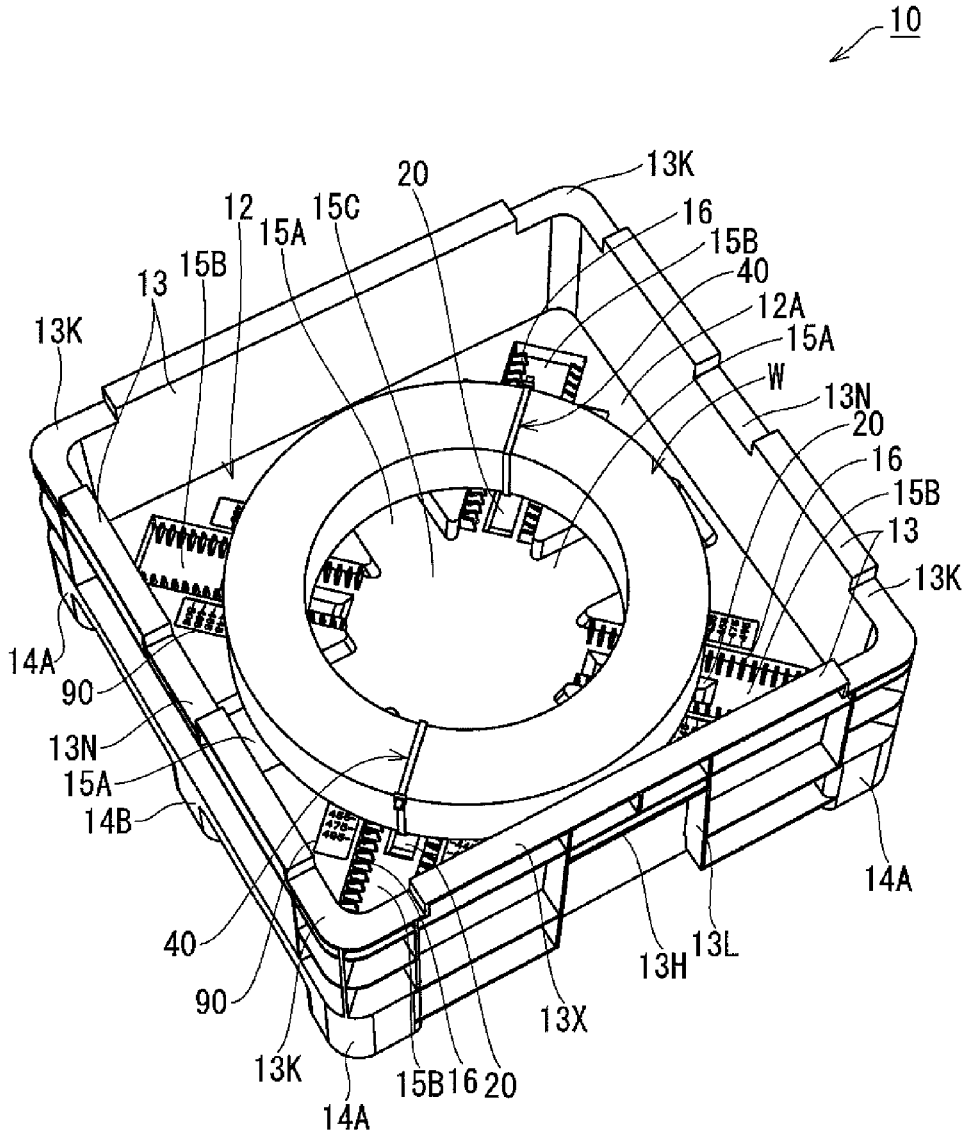
FIG. 5 is a perspective view of the container in the case where bands are used.

The constitution of the container 10 of the embodiment is described above. Next, operation and effects of the container 10 will be described. The rolling bearing W can be fixed to the container 10 in various forms. As one example of the forms, a case will be described below where the rolling bearing W is fixed by only two bands 40 as shown in FIG. 5. The band 40 used herein is a plastic bundling band which is called TY-RAP (registered trademark), insulok or the like and is widely distributed. The band 40 can be fastened by inserting a distal end part thereof into a band insertion hole 40B of a buckle part 40A provided at a proximal end thereof, but the fastening cannot be released. Before using the bands 40, the rolling bearing W is first mounted on the bottom face 12A of the container 10 with the bearing lying down, and then the center of the rolling bearing W is roughly aligned with the center of the center recessed part 15C.

Then, as shown in FIG. 8, the bridging member 21 is covered with the rolling bearing W from above, and both the end parts of the band insertion groove 20 are respectively exposed to an inner space and an outer space of the rolling bearing W. Then, for example, a front end of the band 40 is inserted into the end positioned outside the rolling bearing W, of the band insertion groove 20.

At this moment, the tip end of the band 40 is obliquely inserted between the bottom face 20C of the band insertion groove 20 and the bridging member 21, or is slide-contacted with the inclined face 20A at one end of the band insertion groove 20. The tip end of the band 40 then passes through between the bottom face 20C of the band insertion groove 20 and the bridging member 21 and advances to the other end side of the band insertion groove 20. Then, the tip end of the band 40 is brought into contact with the inclined face 20B positioned inside the rolling bearing W, of the other end part of the band insertion groove 2 and is guided upward. Then, the tip end of the band 40 is picked and inserted into the band insertion hole 40B of the buckle part 40A, and the bearing W and the bridging member 21 are put together and loosely fastened with the band 40.

Next, the other band 40 is inserted into the band insertion groove 20 aligning with the band insertion groove 20 in which the band 40 has been inserted in the same manner, and the rolling bearing W and the bridging member 21 are loosely fastened. Then, the bands 40 are evenly and tightly fastened (see FIG. 7). Then, fixing the rolling bearing W to the container 10 is finished.

Thus, in the container 10 of the embodiment, the rolling bearing W is arranged above the bridging members 21 disposed between the respective paired inner side faces 20S of the band insertion grooves 20 and the bridging members 21 and the rolling bearing W are put together and fastened with the bands 40, whereby both a sideslip and jumping of the rolling bearing W can be prevented. That is, since both the sideslip and jumping of the rolling bearing W can be prevented without a cover for the container 10, the container 10 is more superior in usability to a conventional container requiring a cover, and stacking height can be suppressed.

Additionally, the band 40 can be passed through the inside and outside of the rolling bearing W and wound around the rolling bearing W and the bridging member 21 together. Therefore, the band 40 is further shortened and prevented from loosening as compared with the case where the band 40 is wound so as to surround the entire rolling bearing W or the case where, as conventionally, the band is wound around the whole of the container and the cover.

Additionally, since the tip end of the band 40 is brought into slide-contact with the inclined face 208 (or 20A) at the end part of the band insertion groove 20 and guided upward when the band 40 is made to pass through under the bridging member 21, the winding of the band 40 is easy. Further, when the rolling bearing W is taken out from the container 10, a part of the band 40 stretched between the bridging member 21 and the rolling bearing W can be cut off by inserting scissors or a cutter into the horizontal positioning groove 15. Thus, the removal of the band 40 is also easy.

Additionally, in the container 10 of the embodiment, the band insertion groove 20 is formed in the bottom face 15V of the horizontal positioning groove 15B formed in the bottom wall 12, so that either attaching the sideslip regulating component 30 to the horizontal positioning groove 15B for preventing a sideslip of the rolling bearing W or inserting the band 40 into the band insertion groove 20 for preventing a sideslip and jumping of the rolling bearing W can be selected appropriately, and the degree of freedom of choice of usage of the container 10 is raised.

Figure 6:
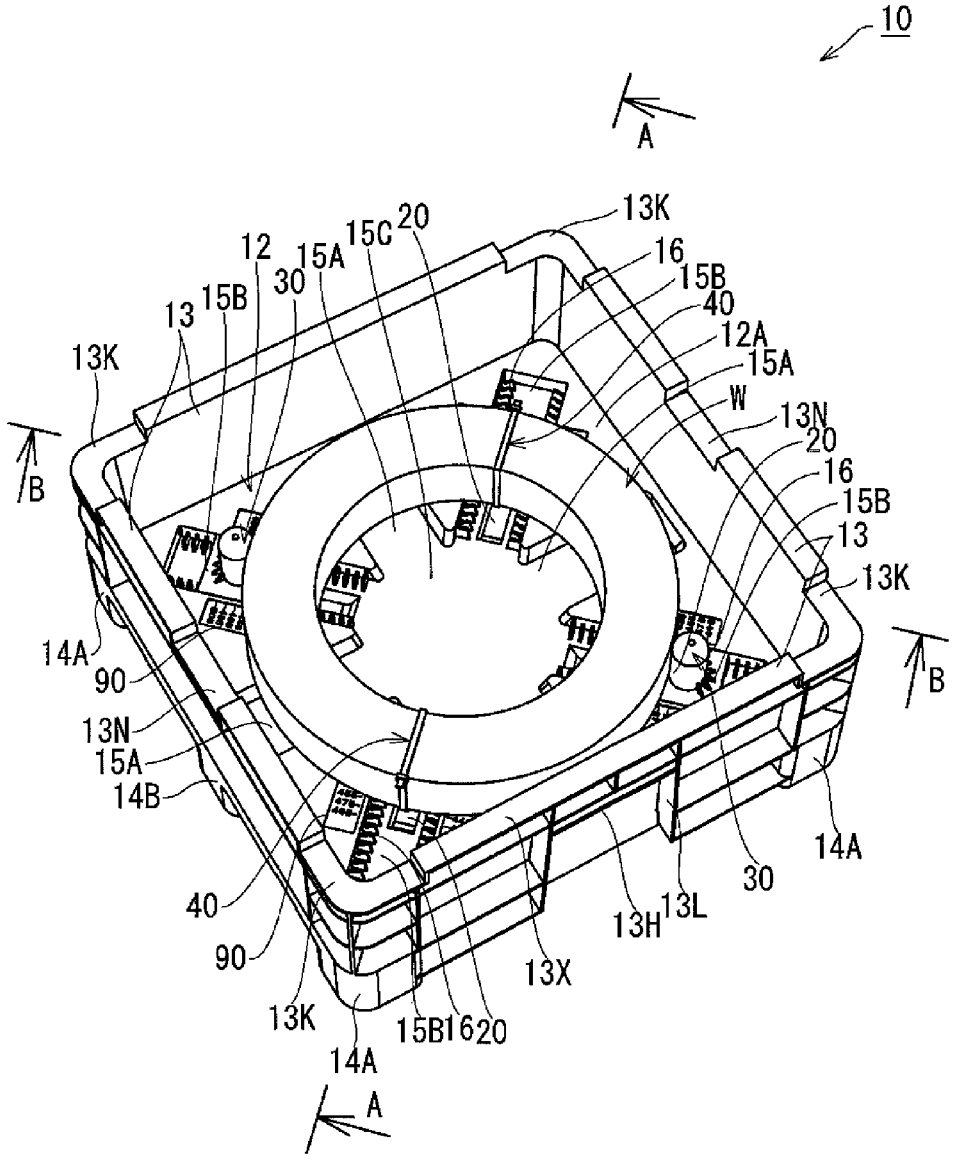
FIG. 6 is a perspective view of the container in the case where the bands and the sideslip regulating components are used.
Figure 7:
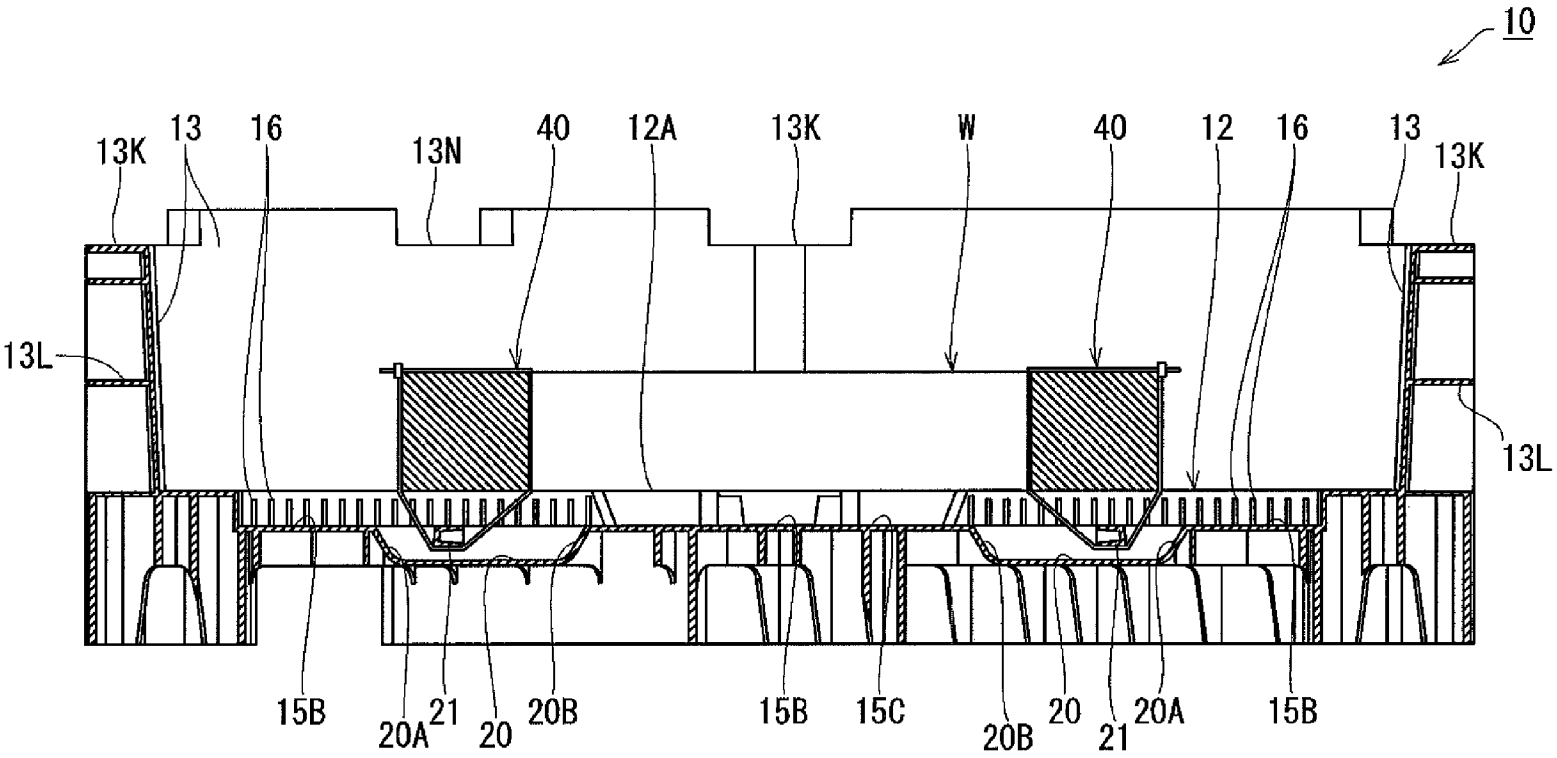
FIG. 7 is a sectional side view of the container, taken along line A-A in FIG. 6.
Figure 9:
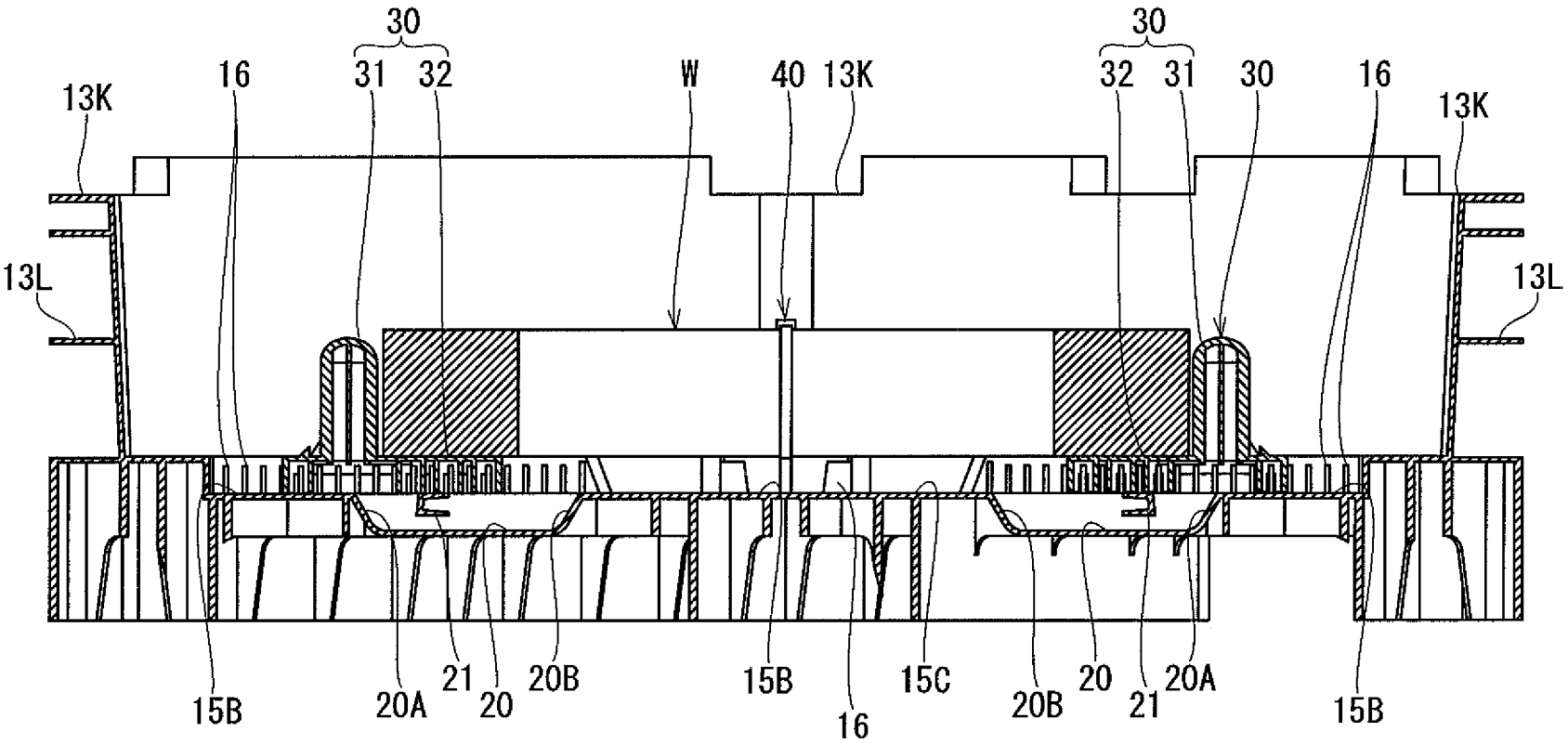
FIG. 9 is a sectional side view of the container, taken along line B-B in FIG. 6.
Figure 10:
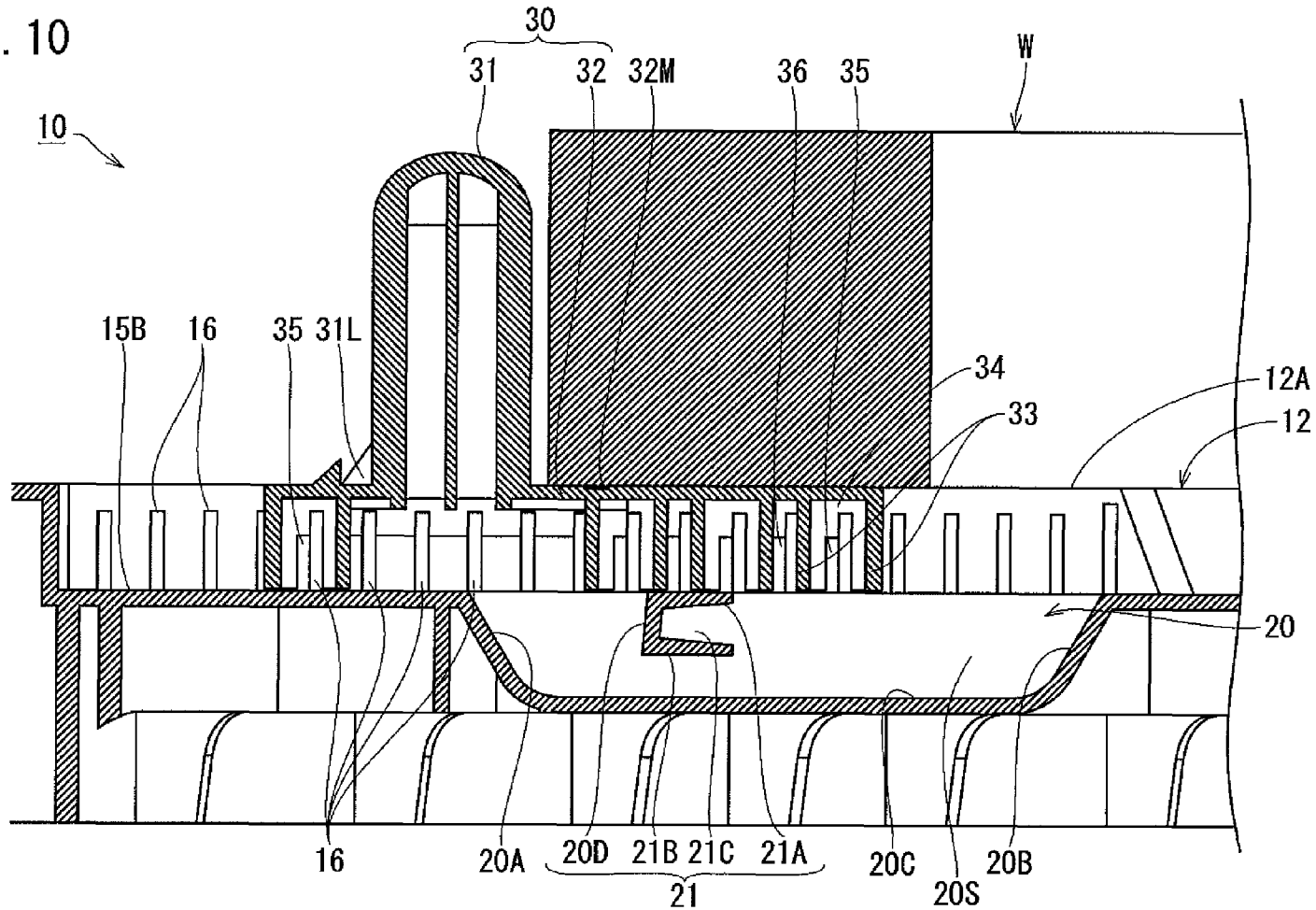
FIG. 10 is a sectional side view of the partially enlarged container.

Specifically, the rolling bearing W may be fixed by two bands 40 and two sideslip regulating components 30, as shown in FIG. 6. In this case, before housing the rolling bearing W in the container 10, the positioning mark 32M of each sideslip regulating component 30 is aligned with the positioning line 90B of the diameter displaying part 90A displaying the same value as that of an outer diameter of the rolling bearing W, the positioning projection part 31 is arranged at a side farther than the positioning mark 32M from the center recessed part 15C, and the base part 32 of each sideslip regulating component 30 is pushed into each horizontal positioning groove 15B from above. Then, as shown in FIG. 10, the positioning projection pieces 16 are housed in the slits 35 of the gate-shaped walls and the projection piece receiving gaps 36, and each engagement leg piece 33 is housed between the adjacent positioning projection pieces 16. The lower ends of the engagement leg piece 33 and the gate-shaped wall 34 come into contact with the bottom face 15V of the horizontal positioning groove 15B, and the upper face of the base part 32 becomes flush with the bottom face 12A of the container 10. The positioning projection, part 31 of each sideslip regulating component 30 is erected from the bottom face 12A. In this state, as shown in FIG. 9, an interval between the positioning projection parts 31 of both the sideslip regulating components 30 becomes substantially the same as the diameter of the rolling bearing

W.

Next, the rolling bearing W is housed between both the positioning projection parts 31 with the bearing lying down. Then, part of the base part 32 of each sideslip regulating component 30 is covered with the rolling bearing W from above, the base part 32 is retained by the horizontal positioning groove 15B, and both the positioning projection parts 31 abut on an outer circumferential face of the rolling bearing W. In this state, similar to the above-described case where the rolling bearing W is fixed by only the two bands 40, the bands 40 each are inserted under each bridging member 21 in each of the band insertion grooves 20 in the other horizontal positioning grooves 153 to which no sideslip regulating components 30 are attached, and the rolling bearing W is fastened with the bands 40. Thus, fixing the rolling bearing W to the container 10 is finished. If the band 40 and the sideslip regulating component 30 are thus used together, the rolling bearing W can be further stabilized in the container 10 and the outer diameter of the rolling bearing W can be easily recognized from the display of the outer diameter displaying part 90, which is indicated by the positioning mark 32M of the sideslip regulating component 30.

Moreover, when there is no possibility that the rolling bearing W jumps, the rolling bearing W can be conveyed by the container 10 in a state where only a sideslip is prevented by attaching the sideslip regulating components 30 to all the horizontal positioning grooves 15B without use of the band 40.

[Other Embodiments]

The present invention should not be limited to the above embodiment, and can be modified in various ways and carried out without departing from the gist thereof.

Figure 11:
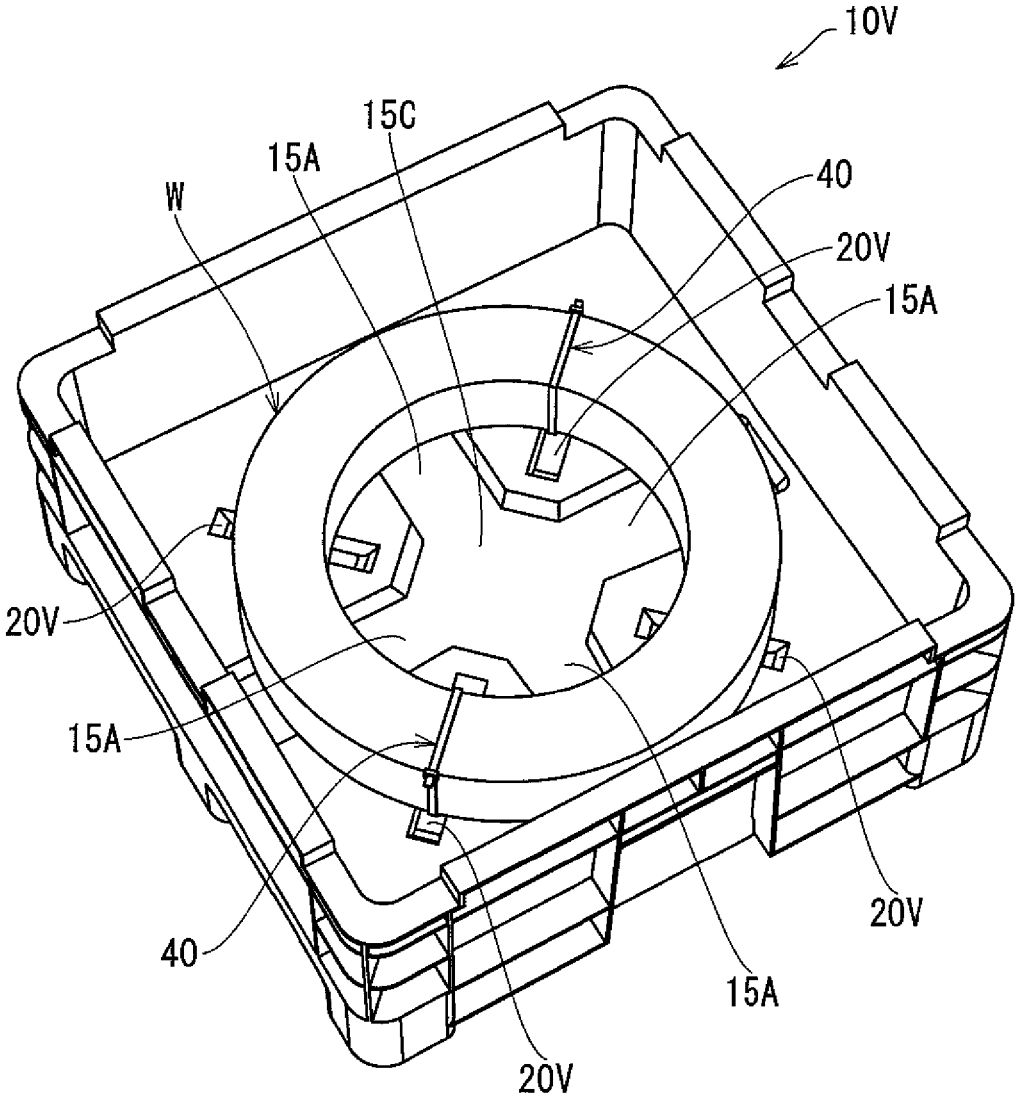
FIG. 11 is a perspective view of a container according to a modification of the present invention.
Figure 12:
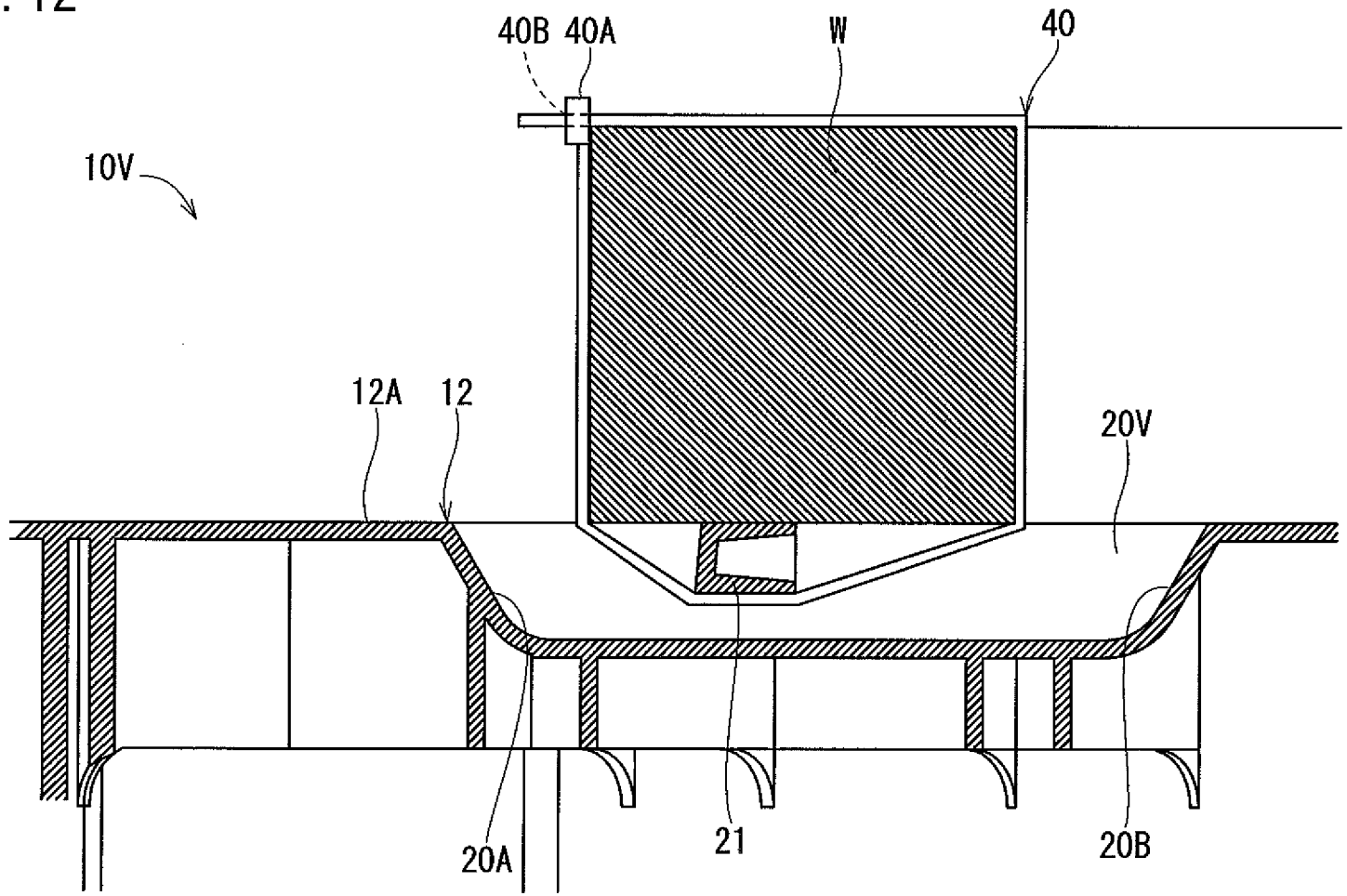
FIG. 12 is a sectional side view of the partially enlarged container according to the modification of the present invention.

(1) In the container 10 of the above embodiment, the band insertion groove 20 is formed in the bottom face 15V of the horizontal positioning groove 15B. However, a horizontal positioning groove and a band insertion groove may be separately provided, or only a band insertion groove may be provided without a horizontal positioning groove. Specifically, for example, the bridging member according to the present invention may be disposed between both inner side faces of each bearing taking-out groove 15A of the above embodiment and each bearing taking-out groove 15A may serve as the band insertion groove according to the present invention. Additionally, as a container 10V shown in FIG. 11, the horizontal positioning groove 15B of the above embodiment is not provided, and band insertion grooves 20V may be formed in the bottom face 12A of the container 10V. In this case, as shown in FIG. 12, a load to the bridging member 21 may be lightened by making an upper face of the bridging member 21 flush with the bottom face 12A to bring the bridging member 21 into contact with a lower face of the rolling bearing W. Additionally, although it is not shown, the bridging member 21 may be separated from the lower face of the rolling bearing W by arranging the upper face of the bridging member 21 lower than the bottom face 12A.

(2) Although the container 10 of the above embodiment is square in the plan view, the shape of the container is not limited to the square. The present invention may be applied to a container which is in the shape of, for example, a rectangle, a polygon other than a rectangle, or a circle in a plan view.

(3) Although the rolling bearing Was the workpiece housed in the container 10 of the above embodiment is in the shape of a ring, the shape of the workpiece is not limited to the ring, and may be, for example, a shaft or a block. Also, when a workpiece is in the shape of a shaft, for example, a plurality of band insertion grooves each having a bridging member are juxtaposed parallelly on a bottom wall of a container, the shaft-shaped workpiece is mounted so as to cross over the band insertion grooves, and bands having been inserted through under the bridging members at a plurality of positions in a longitudinal direction of the workpiece may be wound around the workpiece.

DESCRIPTION OF THE SYMBOLS

10, 10V Container
12 Bottom wall
15A Bearing taking-out groove
15B Horizontal positioning groove
16 Positioning projection piece (Horizontal
16 positioning engaging part)
20, 20V Band insertion groove
20A, 20B Inclined face (Band guide part)
21 Bridging member
30 Sideslip regulating component
40 Band
W Rolling bearing (Workpiece)

The invention claimed is:

1. A container capable of preventing a sideslip and jumping of a housed workpiece, the container comprising:
- a band insertion groove formed in a bottom wall of the container, the band insertion groove having an end part; and
- a bridging member disposed between a pair of inner side faces of the band insertion groove, wherein
- the end part of the band insertion groove has a band guide part, that gradually rises upward from a bottom face of the band insertion groove and increases a distance away from the bridging member.

2. A container capable of preventing a sideslip and jumping of a housed workpiece, comprising:
- a band insertion groove formed in a bottom wall of the container, the band insertion groove having an end part;
- a bridging member disposed between a pair of inner side faces of the band insertion groove; and
- a band configured to wind around the workpiece and the bridging member, wherein
  - the workpiece is arranged above the bridging member, and
  - the end art of the band insertion groove has a band guide part, that gradually rises upward from a bottom face of the band insertion groove and increases a distance away from the bridging member.

3. A container capable of preventing a sideslip and jumping of a housed workpiece, comprising:
- a band insertion groove formed in a bottom wall of the container;
- a bridging member disposed between a pair of inner side faces of the band insertion groove;

a horizontal positioning groove formed in the bottom wall of the container;

a plurality of horizontal positioning engaging parts aligned at a side part of the horizontal positioning groove; and a sideslip regulating component detachably received by the horizontal positioning groove and engaged with at least one of the plurality of horizontal positioning engaging parts, wherein the band insertion groove is formed at a center in a width direction of a bottom face of the horizontal positioning groove.

4. A container capable of preventing a sideslip and jumping of a housed workpiece, comprising:

a band insertion groove formed in a bottom wall of the container;

a bridging member disposed between a pair of inner side faces of the band insertion groove;

a band configured to wind around the workpiece and the bridging member;

a horizontal positioning groove formed in the bottom wall of the container;

a plurality of horizontal positioning engaging parts aligned at a side part of the horizontal positioning groove; and a sideslip regulating component detachably received by the horizontal positioning groove and engaged with at least one of the plurality of horizontal positioning engaging parts, part of the regulating component being covered with the workpiece from above and another part thereof being brought into contact with the workpiece from the side, wherein:

the workpiece is annular and arranged above the bridging member, the band is configured to pass through an inside and around an outside of the annular workpiece, and the band insertion groove is formed at a center in a width direction of a bottom face of the horizontal positioning groove.

5. A container capable of preventing a sideslip and jumping of a housed workpiece, comprising:

a band insertion groove formed in a bottom wall of the container, and having an end part;

a bridging member disposed between a pair of inner side faces of the band insertion groove;

a horizontal positioning groove formed in the bottom wall of the container;

a plurality of horizontal positioning engaging parts aligned at a side part of the horizontal positioning groove; and a sideslip regulating component detachably received by the horizontal positioning groove and engaged with at least one of the plurality of horizontal positioning engaging parts, wherein the band insertion groove is formed at a center in a width direction of a bottom face of the horizontal positioning groove, and the end part of the band insertion groove has a band guide part, the band guide part gradually rises upward from a bottom face of the band insertion groove and increases a distance away from the bridging member.

6. A container capable of preventing a sideslip and jumping of a housed workpiece, comprising:

a band insertion groove formed in a bottom wall of the container and having an end part;

a bridging member disposed between a pair of inner side faces of the band insertion groove;

a band configured to wind around the workpiece and the bridging member;

a horizontal positioning groove formed in the bottom wall of the container;

a plurality of horizontal positioning engaging parts aligned at a side part of the horizontal positioning groove; and a sideslip regulating component detachably received by the horizontal positioning groove and engaged with at least one of the plurality of horizontal positioning engaging parts, a portion of the sideslip regulating component being covered by the workpiece from above and another part thereof being brought into contact with the workpiece from the side, wherein the workpiece is annular and is arranged above the bridging member, the band is configured to pass through an inside and around an outside of the annular workpiece, the end part of the band insertion groove has a bandguide part, the band guide part gradually rises upward from a bottom face of the band insertion groove and increases a distance away from the bridging member, and the band insertion groove is formed at a center in a width direction of a bottom face of the horizontal positioning groove.

* * * * *